US006871403B2

(12) United States Patent
Clark

(10) Patent No.: US 6,871,403 B2
(45) Date of Patent: Mar. 29, 2005

(54) HAIR RAZOR WITH HANDLE HAVING A ROTATABLE FINGER RING

(76) Inventor: Wayne Clark, 16 Culloden Park Rd., San Rafael, CA (US) 94901

( * ) Notice: Subject to any disclaimer, the term of this patent is extended or adjusted under 35 U.S.C. 154(b) by 0 days.

(21) Appl. No.: 10/388,908

(22) Filed: Mar. 17, 2003

(65) Prior Publication Data

US 2004/0181944 A1 Sep. 23, 2004

(51) Int. Cl.[7] ..... B26B 21/10
(52) U.S. Cl. ..... 30/53; 30/30; 30/51
(58) Field of Search ..... 30/30, 32, 50, 30/51, 53, 526, 527, 528, 329, 330, 340; D28/25

(56) References Cited

U.S. PATENT DOCUMENTS 1,359,666 A * 11/1920 Brandt ..... 30/30
1,844,800 A * 2/1932 Schuetz ..... 30/53
2,866,984 A 1/1959 Plough
4,037,322 A * 7/1977 Bresler ..... 30/53
5,348,152 A 9/1994 Kiyoshi et al.
5,649,364 A * 7/1997 Ilanlou ..... 30/40.2
5,704,127 A * 1/1998 Cordio ..... 30/49
6,092,288 A 7/2000 Adachi
6,189,222 B1 * 2/2001 Doyle ..... 30/531

* cited by examiner

*Primary Examiner*—Hwei-Siu Payer
(74) *Attorney, Agent, or Firm*—Joseph L. Strabala, Esq.

(57) ABSTRACT

An improved hair razor includes a cylindrical barrel forming the first part of an elongated handle having a razor blade holder joined to one end thereof, a tubular member forming the second part of the elongated handle having a finger ring formed therein, and an armature means connecting other ends the first part and the second part of the elongated handle in axial alignment, the armature means operable to allow the first part and the second part to rotate relative to each other and selectively lock the first part and the second part against rotation at a plurality of positions. The multiple positions available for the finger ring orientation lessens fatigue and stress of beauticians and barbers using the novel razor.

6 Claims, 3 Drawing Sheets

HAIR RAZOR WITH HANDLE HAVING A ROTATABLE FINGER RING

FIELD OF THE INVENTION

Before the popularity of specialized hair razors, ordinary facial razors were used for cutting hair in procedures commonly known as a "razor cuts". With more and more customers in beauty shops and barbershops asking for razor cuts, specialized hair razor tools have been developed for such procedures. These implements typically have an elongated handle fixedly joined with a blade cartridge holder, so that the a fresh blade can quickly be inserted into the implement by replacing the blade cartridge.

One such implement is disclosed in U.S. Pat. No. 6,092,288 issued to Adachi and a typical prior art hair razor is shown in FIG. 1 of the drawings accompanying this specification. More particularly these hair razors typically have a stiff elongated handle which is fixedly joined to a blade cartridge holder that receives a cartridge containing a razor blade. This handle and cartridge holder are general axially aligned and typically the handle is an elongated bar-like shaft which shaped for convenient griping with a finger ring at its distal end. In the above referenced patent, the finger ring is centrally located in the handle offering a beautician or barber the ability to handle the hair razor more adroitly, according to the inventor.

In such prior art implements the beautician or barber must accept the fixed location of finger ring on the razor and its orientation relative to the rest of the razor. For some, this permanent arrangement of the finger ring is an inconvenience or becomes so during prolong use of the razor. One approach has been to make the handle of a moldable plastic which can be heated and then bent into a shape suitable to the user of the hair razor. Of course this again results in a fixed finger ring location when the razor is in use.

An object of the current invention is to provide users of hair razors with flexible gripping arrangements to reduce strain and maladies, such as carpal tunnel syndrome. The current invention provides such a novel hair razor having a finger ring that has multiple positions for flexibility in holding the hair razor to reduce hand and arm strain for barbers and beauticians.

Another object of the invention is the provision of a hair razor which has improved balance by providing a finger ring on the handle with different orientations relative to the razor with a convenient gripping cylinder, so that the razor can be stabilized by the little finger of the user for more deft control of the hair razor.

Other objects and advantages will be apparent when viewing the drawings in conjunction with the specification describing this invention.

SUMMARY OF THE INVENTION

A hair razor having a handle connected to a blade cartridge holder, the improvement including constructing the handle in two parts with the first part fixedly connected to the blade cartridge holder at one end and the second part having a finger ring at distal end connected to the first part of the handle in axial alignment by an armature which allows the second part to be unlocked from the first part and rotated relative to the first part and then locked against further rotation relative to the first part thereby providing multiple positions for the finger ring relative to the first part of the handle and the blade cartridge holder.

PRIOR ART HAIR RAZOR

Figure 1:
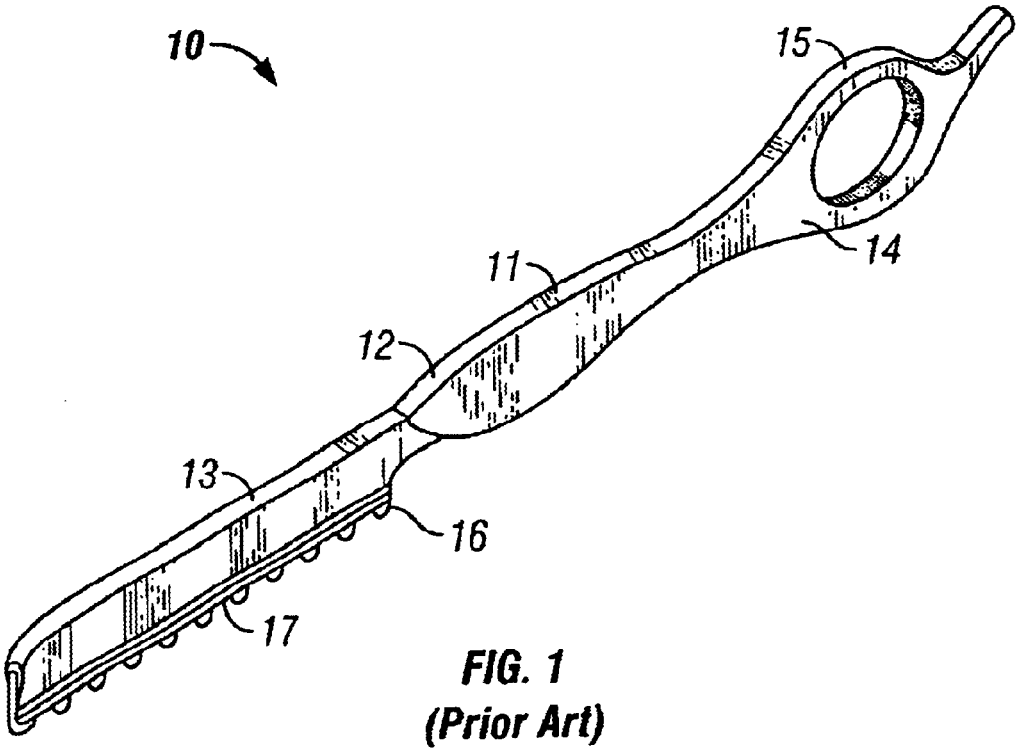
FIG. 1 (Prior Art)
FIG. 1 is a perspective of a typical prior art hair razor.

FIG. 1 illustrates a prior art hair razor 10 of the type typically available in the market place. It includes an elongated handle 11 which has one end 12 fixedly connected to a blade cartridge holder 13 and, at the other end 14, a finger ring 15. The blade cartridge holder is designed to receive a blade cartridge 16 that includes a razor blade 17.

As can be seen from FIG. 1 the finger ring is fixed relative to the handle and the blade cartridge holder.

DESCRIPTION OF AN EMBODIMENT OF THE INVENTION THE INVENTION

Figure 2:
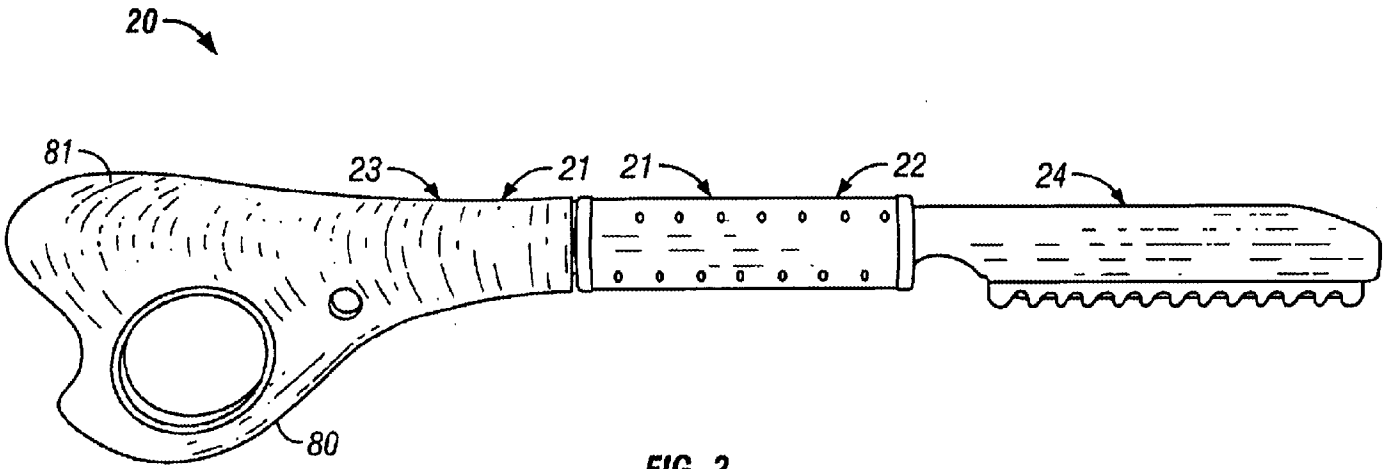
FIG. 2 is a perspective of the novel hair razor showing an embodiment of the invention.

In contrast to the hair razor shown in FIG. 1, the novel hair razor 20 illustrated in FIGS. 2 though 5 has its handle 21 constructed of principal two parts, a cylindrical handle portion 22 forming one part of the handle and a finger ring portion 23 of the handle forming the other part of the handle with the two parts joined in coaxial alignment.

Figure 3:
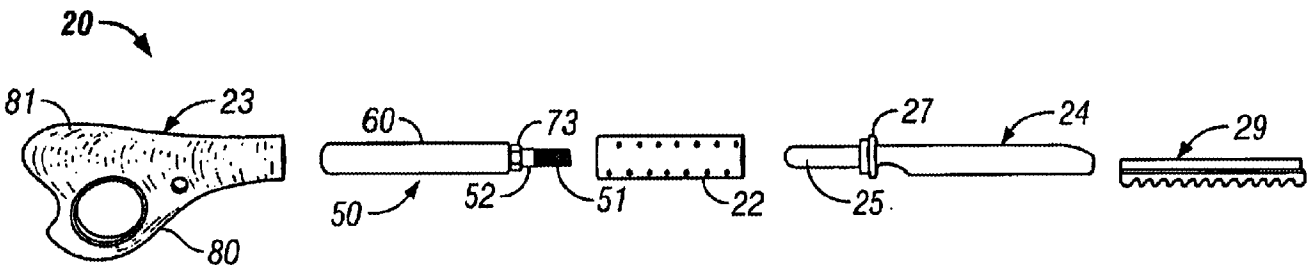
FIG. 3 is a an exploded perspective of the novel hair razor shown in FIG. 2, illustrating the various major components of the hair razor.

The connection between these two principal components of the handle 21 and the connection of the handle to is blade cartridge holder 24 is best illustrated in FIG. 3 which shows the parts of the novel razor in an exploded view. As can be seen in this FIG. the blade cartridge holder 24 has a boss 25 at one end 26 that has a stepped washer 27 at the junction of the boss and blade cartridge holder 28 designed to receive the blade cartridge 29.

Figure 4:
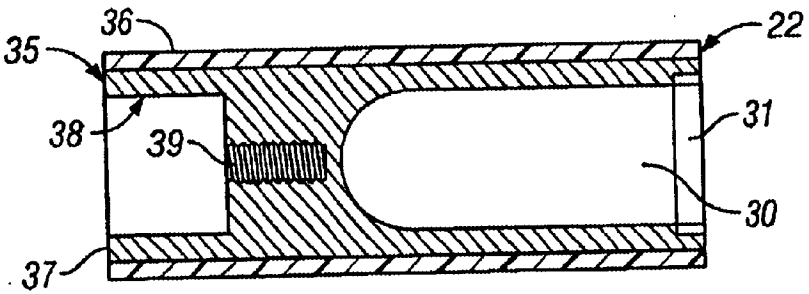
FIG. 4. is a section of the gripping or control cylinder of the hair razor shown in FIGS. 2 and 3.

The boss 25 is fixedly received in a bore 30 in the cylindrical portion 22 of the handle 21, which bore is shown in FIG. 4 and includes a slightly larger bore 31 at its distal end to received the stepped portion of the washer 27 so the blade cartridge holder is esthetically joined with this portion of the handle when the boss is forced into the smaller of the two bores. Other techniques of connecting the blade cartridge holder to the cylindrical portion of the handle can be employed, such as providing threads in the bore 30 and threading the boss 25, or gluing the boss in the bore with epoxy or the like, as it is designed to be a permanent or fixed connection between these parts.

Referring to FIG. 4, it can be seen that the cylindrical portion 22 of the handle 21 has a cylindrical core 35 which has a rubber or elastomer outer sleeve 36 that forms a convenient gripping surface on the handle when the novel razor is in use. This core at end 37, opposite the bore 30, has a secondary bore 38 which terminates in smaller internal threaded bore 39. One end of the armature 50, shown in FIG.

5, is assembled with the core when its treaded end 51 is screwed into the into the threaded bore 39 as its boss 52 slides into the secondary bore 38 in the core.

Figure 5:
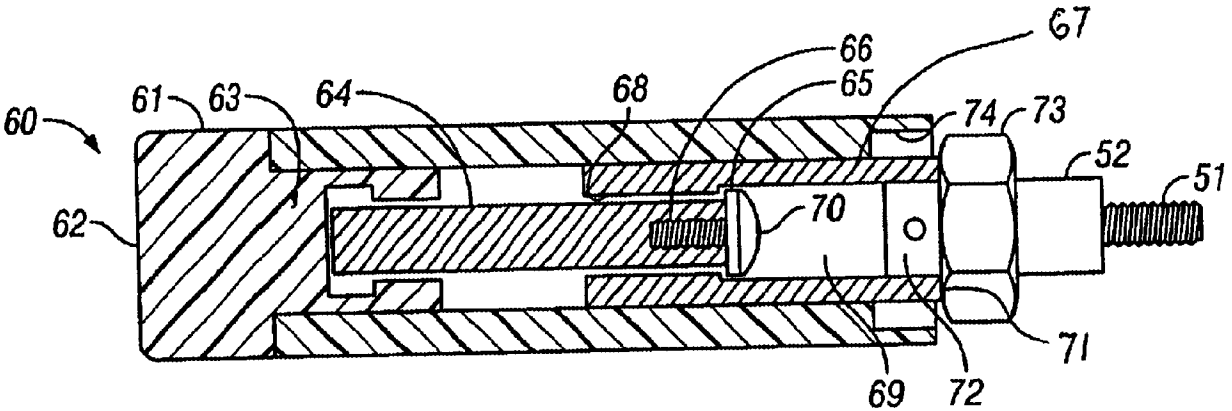
FIG. 5 is a section of the armature assembly which connects the finger ring portion of the handle to the gripping or control cylinder part of the handle to form the handle and enables the finger ring portion to be rotated relative to this cylinder after it is unlocked and then locked in a selected position when the user has obtained the desired orientation of the finger ring in the handle.
Figure 6:
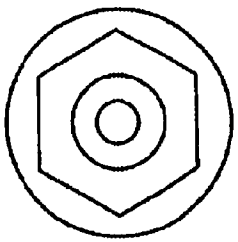
FIG. 6 is an end view of the armature assembly shown in FIG. 5.

The armature 50 is best shown in FIG. 5 and includes a cylindrical shell 60 which is closed at one end 61 by a plug 62 which supports one end 63 of a slide rod 64. At the exposed end 65 of the slide rod is a thread bore 66. A cylindrical shuttle 67 having stepped, concentric bores 68 and 69, is mounted so its smaller bore 68 is received on the slide rod and a cap screw 70 is screwed into the bore 66 of the slide rod to prevent the shuttle from sliding out of the armature. This arrangement allows the shuttle to move back and forth inside the armature, as can be appreciated from viewing FIG. 5.

Capping the open end 71 larger bore 69 of the cylindrical shuttle 67 is a boss 72 which is pinned or other wise secured in the this bore. The boss is connected a hex fitting 73 that is secured between it and the boss 52 which is received in the first portion 22 of the handle 21 as previously described. As can be appreciated when viewing FIG. 5, the hex fitting moves with the shuttle when it is moved axially on the slide rod 64. By forming a hex opening 74 in the open end 71 of the shell 60 movement of the shuttle on the slide rod will move the hex fitting into and out of the hex opening. It can be appreciated when the hex fitting is in the hex opening this fitting, which is connected to the cylindrical portion 22 of the handle 21, can not be rotated but when the hex fitting is out of the hex opening, rotation can occur between the cylindrical shell and the shuttle and its connected hex fitting.

Using the hex fitting 73 and a hex opening 74 in the cylindrical shell 60 sized to snugly receive the fitting, rotation between the shell and the fitting can occur when the fitting is outside the hex opening but is prevented or locked when the fitting is in this opening. The snug fit will insure the fitting stays in the hex opening when it is pushed into it by a user. While the hex fitting and hex opening provides six separate positions, it should be appreciated that other arrangements, functioning as described, can provide more positions, e.g., such as octal fitting and an octal opening.

To complete the construction of the novel hair razor, the cylindrical shell 60 of the armature 50 is inserted into the second portion 23 of the handle 21 and secured therein so that relative movement is prevented. Once this is accomplished, it can be appreciated that this portion of the handle having the finger ring 80 at its distal end 81 can be rotated relative to the cylindrical portion 22 of the handle when the hex fitting 73 is out of the hex opening 74. As a result the finger ring can re-positioned so that it has, in the case of this embodiment, six separate orientations, in each of which it can be locked by merely pushing the hex fitting into the hex opening of the armature. Moreover this portion of the handle has a bulbous end which also aids in manipulating the hair razor when its is in use regardless of the orientation of the finger ring.

Other embodiments are contemplated such as a having the shuttle spring loaded so that it keeps the two parts of the handle together, subject to the user pulling the shuttle partially out of the armature to reposition the finger ring.

Having described my invention, I claim:

1. An improved hair razor comprising:

a cylindrical barrel forming the first part of an elongated handle having a razor blade holder joined to one end thereof;

a tubular member forming the second part of said elongated handle having a finger ring formed thereon, an armature means connecting other ends of said first part and said second part of said elongated handle in axial alignment, said armature means operable to allow said first part and said second part of said elongated handle to rotate relative to each other and lock said first part and said second part against rotation at a plurality of selected positions.

2. The improved hair razor defined in claim 1 wherein the finger ring is located adjacent to one end of the tubular member.

3. The improved hair razor defined in claim 1 wherein the cylindrical barrel is covered with a rubberized sleeve.

4. The improved hair razor defined in claim 1 wherein the tubular member has a bulbous end adjacent to the finger ring.

5. An improved hair razor comprising:

a two part handle, said parts connected by an armature means operable to allow said parts to rotate relative to one another and to selectively lock said parts in selected positions;

a razor blade holder means connected to one end of said two part handle operable to enable blade cartridges to be inserted and removed therefrom to change razor blades in said hair razor; and a finger ring located adjacent to the end of said two part handle opposite the end connected to the blade holder means.

6. An improved hair razor as defined in claim 5 wherein the parts of the two part handle are connected by said armature means in axial alignment.

* * * * *